US008803042B2

(12) United States Patent
Buccheri et al.

(10) Patent No.: US 8,803,042 B2
(45) Date of Patent: Aug. 12, 2014

(54) THERMAL PROTECTION DEVICE AND METHOD

(75) Inventors: Nicholas F. Buccheri, Florham Park, NJ (US); John J. Haller, Boonton, NJ (US)

(73) Assignee: Automatic Switch Company, Florham Park, NJ (US)

( * ) Notice: Subject to any disclaimer, the term of this patent is extended or adjusted under 35 U.S.C. 154(b) by 389 days.

(21) Appl. No.: 13/245,214

(22) Filed: Sep. 26, 2011

(65) Prior Publication Data

US 2012/0112870 A1 May 10, 2012

Related U.S. Application Data

(60) Provisional application No. 61/410,424, filed on Nov. 5, 2010.

(51) Int. Cl.

| | |
|---|---|
| ***H05B 1/02*** | (2006.01) |
| ***H01H 85/02*** | (2006.01) |
| *H01H 85/00* | (2006.01) |
| *H01F 7/06* | (2006.01) |
| *H01H 37/32* | (2006.01) |

(52) U.S. Cl.

CPC ..... *H01H 85/0241* (2013.01); *H01F 7/06* (2013.01); *H01H 37/32* (2013.01)

USPC ..... 219/514; 219/523; 219/510; 337/1

(58) Field of Classification Search

USPC ..... 219/514, 523, 510, 517, 481; 337/1, 4, 337/405, 182, 6, 23, 31, 54–5

See application file for complete search history.

(56) References Cited

U.S. PATENT DOCUMENTS

| | | | | |
|---|---|---|---|---|
| 2,941,308 | A * | 6/1960 | Cobb et al. | 34/552 |
| 3,839,692 | A | 10/1974 | Plasko | |
| 4,227,169 | A | 10/1980 | McVey et al. | |
| 4,808,960 | A | 2/1989 | Nixon | |
| 4,821,010 | A | 4/1989 | Plasko | |
| 4,968,962 | A | 11/1990 | Hohider et al. | |
| 5,304,974 | A | 4/1994 | Denton | |

* cited by examiner

*Primary Examiner* — Shawntina Fuqua
(74) *Attorney, Agent, or Firm* — Locke Lord LLP

(57) ABSTRACT

A solenoid valve for use in a hazardous environment requiring a surface temperature of the valve to not exceed a cutoff temperature, the valve comprising coil configured to physically move an armature using an field generated by the coil; a thermal cutoff device having a fusing temperature above the cutoff temperature; and a heating resistor sized and configured to raise thermal cutoff device's temperature to the fusing temperature before the surface temperature exceeds the cutoff temperature. A method of constructing a solenoid valve for use in a hazardous environment requiring a surface temperature of the valve to not exceed a cutoff temperature, the method comprising the steps of: selecting a thermal cutoff device having a fusing temperature above the cutoff temperature; and selecting and configuring a heating resistor to raise thermal cutoff device's temperature to the fusing temperature before the surface temperature exceeds the cutoff temperature.

16 Claims, 1 Drawing Sheet

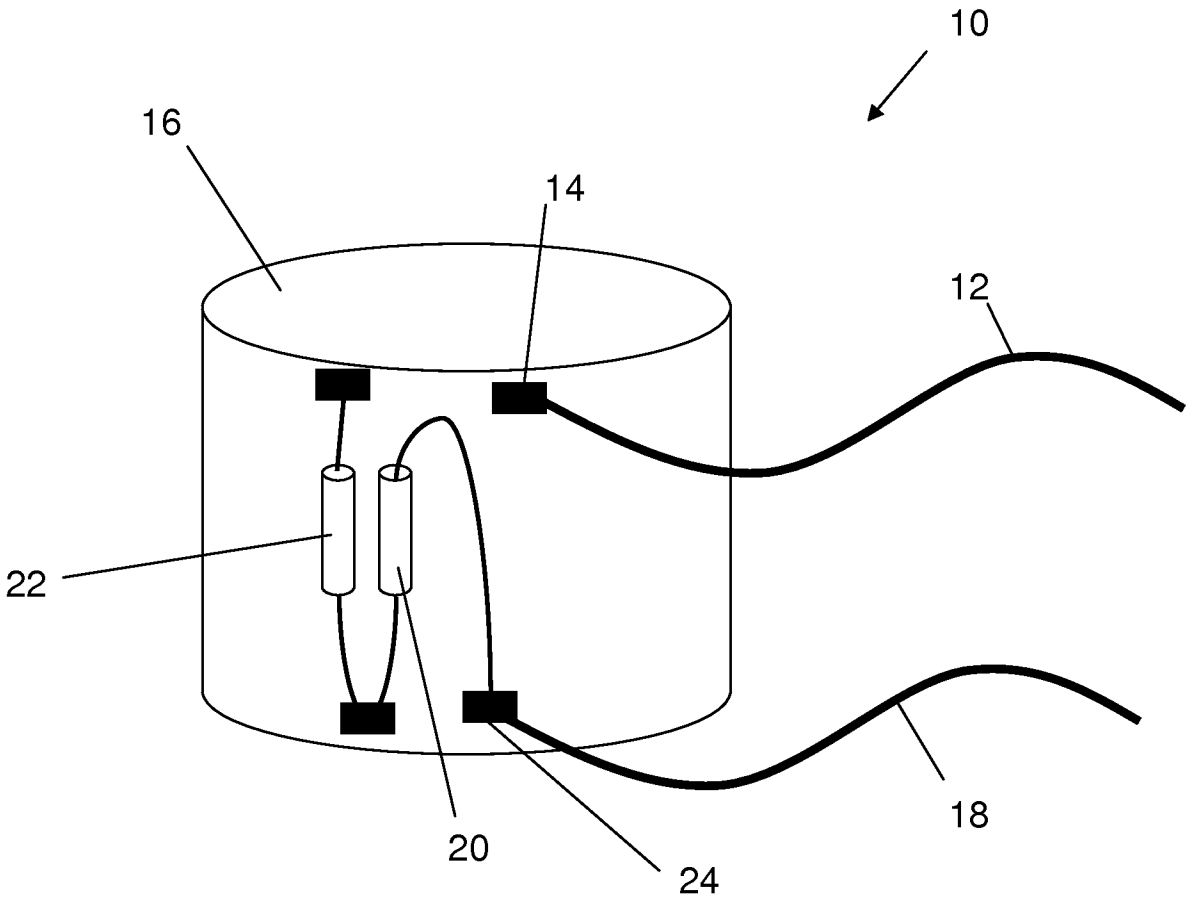
10
12
14
16
18
20
22
24

THERMAL PROTECTION DEVICE AND METHOD

CROSS REFERENCE TO RELATED APPLICATIONS

This application is a non-provisional of, and claims priority benefit of, U.S. application Ser. No. 61/410,424, filed Nov. 5, 2010, which is incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to solenoid valves; and more specifically relate to thermal protection of solenoid valves operating in hazardous environments.

2. Description of the Related Art

U.S. Pat. No. 3,839,692 discloses "a thermal limiter construction which can be used to limit one or more electrical circuits and comprises a thermally responsive device having leads for being interconnected into such electrical circuit or circuits and a plurality of electrically operated heaters disposed adjacent the device and each being adapted to cause the device to open the circuit or circuits when heated by the respective heater a certain amount."

U.S. Pat. No. 4,227,169 discloses a "device [that] will open an electrical circuit in response to either an increase in ambient temperature or an increase in electrical current. A bracket is provided to support a radial lead thermal cut-off device. The bracket is of a general C-shaped configuration and has an extending lead bar that is crimped into electrical engagement with an input lead, and one radial lead of the thermal cut-off device is crimped into electrical engagement with the second input lead. A helical conductive coil has one end welded or otherwise secured to the C-shaped bracket, and the second lead of the thermal cut-off device is crimped to the other end of the helical coil which is positioned over the thermal cut-off device so as to surround it. Thus, an ambient temperature rise may cause the thermal cut-off device to open the electrical circuit; or alternately the heat generated by the I.sup.2 R loss in the coil due to excessive electrical current flow may cause the device to also open."

U.S. Pat. No. 4,808,960 discloses a "thermal cutoff having a metal foil resistance heater circuit bonded to its outer surface."

U.S. Pat. No. 4,821,010 discloses a "thermal cutoff includes a housing having a resistive coating bonded thereto, and defining a heater for heating the thermal cutoff to its firing temperature."

U.S. Pat. No. 4,968,962 discloses a "thermal cutoff and a heating resistor are assembled in heat transfer relationship with one another by a metal clip. The assembly is mounted on a base of dielectric material. Electric leads on the thermal cutoff and resistor extend through holes in the base for connection to a printed circuit board."

U.S. Pat. No. 5,304,974 discloses a "thermal cut-off resistor that has an elongated thermal cut-off fuse; a wire-shaped resistor that is tightly coiled around the fuse, said resistor being physically connected to the fuse so that the fuse and the resistor are in an electrical series arrangement; and an electrically-insulated heat-resistant casing that contains the fuse and resistor therein and enables the fuse and the resistor to be secured and electrically connected to respective electrical contacts formed on a printed circuit board, the profile of the casing being approximately the width of the fuse."

The inventions disclosed and taught herein are directed to an improved system for thermal protection.

BRIEF SUMMARY OF THE INVENTION

The present invention relates to a solenoid valve for use in a hazardous environment requiring a surface temperature of the valve to not exceed a cutoff temperature, the valve comprising coil configured to physically move an armature using an field generated by the coil; a thermal cutoff device having a fusing temperature above the cutoff temperature; and a heating resistor sized and configured to raise thermal cutoff device's temperature to the fusing temperature before the surface temperature of the valve exceeds the cutoff temperature. The present invention also relates to a method of constructing a solenoid valve for use in a hazardous environment requiring a surface temperature of the valve to not exceed a cutoff temperature, the method comprising the steps of: selecting a thermal cutoff device having a fusing temperature above the cutoff temperature; and selecting and configuring a heating resistor to raise thermal cutoff device's temperature to the fusing temperature before the surface temperature of the valve exceeds the cutoff temperature.

BRIEF DESCRIPTION OF THE SEVERAL VIEWS OF THE DRAWINGS

FIG. 1 illustrates a particular embodiment of a thermal protection assembly utilizing certain aspects of the present inventions.

DETAILED DESCRIPTION OF THE INVENTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a solenoid valve for use in a hazardous environment requiring a surface temperature of the valve to not exceed a cutoff temperature, the valve comprising coil configured to physically move an armature using an field generated by the coil; a thermal cutoff device having a fusing temperature above the cutoff temperature; and a heating resistor sized and configured to raise thermal cutoff device's temperature to the fusing temperature before the surface temperature of the valve exceeds the cutoff temperature. The present invention also relates to a method of constructing a solenoid valve for use in a hazardous environment requiring a surface temperature of the valve to not exceed a cutoff temperature, the method comprising the steps of: selecting a thermal cutoff device having a fusing temperature above the cutoff temperature; and selecting and configuring a heating resistor to raise thermal cutoff device's temperature to the fusing temperature before the surface temperature of the valve exceeds the cutoff temperature.

In applications of solenoid valves in hazardous environments it critical that the temperature of the surface of a coil of the valve never exceeds certain predetermined limits based on the type of potentially explosive atmospheres that may be present. One method of insuring that this will not occur is by the inclusion of a thermal cut off (TCO) device on the winding of the coil. If an abnormal condition occurs, such as a solenoid valve becoming stuck in the closed position and when power is applied the solenoid was unable to move it's armature to the full open position, power consumed by the coil would increase to a level which would make it's surface temperature exceed the safe limits of the environment. This scenario is avoided by the presence of the TCO, which will open the electrical circuit when the coil meets or exceeds its cutoff temperature.

There are a number of TCO technologies available to accomplish this, but the most reliable on for this type of a critical application is the eutectic type TCO. These devices are typically composed of a ceramic tube filled with an eutectic alloy with electrical connections extending from each end. The lead wires are secured in the tube with a high temperature epoxy compound.

The fusing temperatures of these devices are accurate since they are based on the eutectic melting properties of the alloy chosen. Since there are a finite number of eutectic alloy combinations that melt at certain temperatures the operating temperatures are limited to what we find in nature. Designs must be tailored to the available temperatures. However, there are finite combinations, and thus there are finite fusing temperatures. If a different fusing temperature is needed these prior art devices do not provide a solution.

One purpose of the present invention is to be able to adjust the operating point of a given TCO device by electrically coupling it to a heating resistor that is in thermal contact with the TCO device with a fusing temperature that is greater than the desired cutoff temperature for the coil. The heating resistor is sized so that, in an abnormal condition of operation of the solenoid valve, the power this resistor consumes will provide the additional temperature rise in the TCO device to allow it to reach the higher fusing temperature, while the coil winding and subsequently the surface temperature of the coil is kept at a value that is safe for the environment in which it is operating.

FIG. 1 is an illustration of one particular embodiment of just such a system 10. As shown, one of two lead wires 12 is directly connected to one of two terminals 14 of a coil 16 for a solenoid valve. The other lead wire 18 is connected to a thermal cut off (TCO) device 20. The TCO device 20 is deliberately chosen to create an open circuit at a fusing temperature that is greater than the desired cutoff temperature for the hazardous environment in which the solenoid valve will operate. This, of course, goes directly against the current teaching in the relevant arts.

In order to protect the solenoid valve, and surrounding equipment in the hazardous environment, and ensure that the TCO will trip when, or before, the surface temperature of the solenoid valve reaches the desired cutoff temperature for the hazardous environment in which the solenoid valve will operate, a heating resistor 22 is thermally coupled to the TCO 20. As current flows through the coil 16, the TCO's 20 temperature rises. As current flows through the resistor 22, the TCO's 20 temperature rises. The temperature of the coil 16 and the resistor 22 thereby cooperate to raise the TCO's 20 temperature above that of the coil 16 alone. Once the temperature of the TCO 20 meets or exceeds its fusing temperature, the TCO 20 trips thereby creating an open circuit and preventing the surface temperature of the solenoid valve from exceeding the desired cutoff temperature for the hazardous environment.

In other words, the resistor 22 is preferably sized to transfer sufficient heat to the TCO 20, whenever an abnormal condition exists. More specifically, the resistor 22 is preferably sized such that a fault current will generate sufficient heat to quickly raise the temperature of the TCO 20 to its fusing temperature, and thereby trip the TCO 20, before the surface temperature of the solenoid valve exceeds the desired cutoff temperature. Alternatively or additionally, the resistor 22 may be sized such that any abnormal condition, such as when a solenoid valve becomes stuck in the closed or open, producing an abnormal current through the resistor 22 will generate sufficient heat to raise the temperature of the TCO 20 to its fusing temperature, over time, and thereby trip the TCO 20, before the surface temperature of the solenoid valve exceeds the desired cutoff temperature.

As shown, the TCO 20 and the resistor 22 may be wired in series between one of the leads 18 and one of the terminals 24 of the coil 16. However, in other applications, the TCO 20 and the resistor 22 may be wired independently and/or wired in parallel.

The resistor 22 and TCO 20 may be potted within the solenoid valve assembly to prevent the hazardous environment from being exposed to the temperature of the resistor 22 and/or TCO 20. This may allow the solenoid valve to meet any required certifications for the hazardous environment. For example, the present invention allows the solenoid valve to be reliably disabled at a cutoff temperature well below the fusing temperature of the TCO 20. This, in turn, allows virtually any cutoff temperature specification to be met, depending upon the size/rating/resistance/value of the heating resistor, independently of the available TCO ratings. In other words, one need not have a TCO rated at the exact cutoff temperature specification needed. Rather, one can use a readily available TCO, with a rating higher than the cutoff temperature specification, and then size the resistor to raise the TCO's temperature before the coil exceeds the cutoff temperature specification.

Other and further embodiments utilizing one or more aspects of the inventions described above can be devised without departing from the spirit of Applicant's invention. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A solenoid valve for use in a hazardous environment requiring a surface temperature of the valve to not exceed a cutoff temperature, the valve comprising:

a coil configured to physically move an armature using an field generated by the coil;

a thermal cutoff device having a fusing temperature above the cutoff temperature; and a heating resistor sized and configured to raise a core temperature of the thermal cutoff device to the fusing temperature before the surface temperature of the valve exceeds the cutoff temperature.

2. The valve as set forth in claim 1, further including a first lead wire directly coupled to the coil and a second lead wire coupled to the coil through the thermal cutoff device and the resistor.

3. The valve as set forth in claim 1, wherein the resistor is wired in series with the thermal cutoff device.

4. The valve as set forth in claim 1, wherein the resistor is wired in parallel with the thermal cutoff device.

5. The valve as set forth in claim 1, wherein the resistor is wired in parallel with a portion of the coil.

6. The valve as set forth in claim 1, wherein the resistor is wired in parallel with the coil.

7. The valve as set forth in claim 1, wherein the resistor is mounted in thermal contact with the thermal cutoff device.

8. The valve as set forth in claim 1, wherein the valve is mounted in a hazardous environment and the resistor is sized and configured to raise an internal temperature of the valve.

9. A method of constructing a solenoid valve for use in a hazardous environment requiring a surface temperature of the valve to not exceed a cutoff temperature, the method comprising the steps of:

selecting a thermal cutoff device having a fusing temperature above the cutoff temperature; and selecting and configuring a heating resistor to raise a core temperature of the thermal cutoff device to the fusing temperature before the surface temperature of the valve exceeds the cutoff temperature.

10. The method as set forth in claim 9, further including the steps of coupling a first lead wire directly to the coil and coupling a second lead wire to the coil through the thermal cutoff device and the resistor.

11. The method as set forth in claim 9, further including the step of wiring the resistor in series with the thermal cutoff device.

12. The method as set forth in claim 9, further including the step of wiring the resistor in parallel with the thermal cutoff device.

13. The method as set forth in claim 9, further including the step of wiring the resistor in parallel with a portion of the coil.

14. The method as set forth in claim 9, further including the step of wiring the resistor in parallel with the coil.

15. The method as set forth in claim 9, further including the step of mounting the resistor in thermal contact with the thermal cutoff device.

16. The method as set forth in claim 9, further including the step of mounting the valve in a hazardous environment and wherein the step of selecting and configuring the resistor includes selecting and configuring the resistor to raise an internal temperature of the valve.

* * * * *